US009982537B2

(12) United States Patent
Cawood et al.

(10) Patent No.: US 9,982,537 B2
(45) **Date of Patent: *May 29, 2018**

(54) METHOD OF SUPPORTING A ROCK WALL

(71) Applicant: NCM INNOVATIONS (PTY) LTD, Aeroton, Johannesburg (ZA)

(72) Inventors: Martin Cawood, Johannesburg (ZA); Paolo Ettore Pastorino, Johannesburg (ZA); Phillipus Van Der Merwe, Johannesburg (ZA); Samuel Du Plessis, Johannesburg (ZA)

(73) Assignee: NCM INNOVATIONS (PTY) LTD, Johannesburg (ZA)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/680,640

(22) Filed: Aug. 18, 2017

(65) Prior Publication Data

US 2017/0342836 A1 Nov. 30, 2017

Related U.S. Application Data

(62) Division of application No. 14/908,198, filed as application No. PCT/ZA2014/000076 on Dec. 11, 2014, now abandoned.

(30) Foreign Application Priority Data

Dec. 12, 2013 (ZA) ..... 2013/09368

(51) Int. Cl.
*E21D 20/02* (2006.01)
*E21D 21/00* (2006.01)

(52) U.S. Cl.
CPC ..... *E21D 20/021* (2013.01); *E21D 20/023* (2013.01); *E21D 20/028* (2013.01);
(Continued)

(58) Field of Classification Search
CPC .. E21D 20/02; E21D 21/0026; E21D 21/0046
(Continued)

(56) References Cited

U.S. PATENT DOCUMENTS 3,837,258 A * 9/1974 Williams ..... E21D 20/00 405/259.3
4,194,858 A 3/1980 Evans
(Continued)

FOREIGN PATENT DOCUMENTS

DE 2108264 9/1971
WO 2006034208 3/2006
(Continued)

OTHER PUBLICATIONS

International Search Report PCT/ZA2014/000076 dated Nov. 25, 2015.

*Primary Examiner* — Sunil Singh
(74) *Attorney, Agent, or Firm* — Young & Thompson

(57) ABSTRACT

A rock bolt includes an elongate metallic body having a first end and an opposed second end, a threaded portion at the second end, for attaching thereto and locating thereon, a nut and a bearing plate, a mechanical anchor at, or at least partially located on, a first end portion of the body and a first resistive anchor, located between the threaded portion and the mechanical anchor.

5 Claims, 4 Drawing Sheets

(52) U.S. Cl.
CPC ..... *E21D 21/004* (2013.01); *E21D 21/0006* (2013.01); *E21D 21/008* (2013.01); *E21D 21/0046* (2013.01); *E21D 21/0086* (2013.01); *E21D 20/02* (2013.01); *E21D 21/0026* (2013.01)

(58) Field of Classification Search
USPC ..... 405/259.1–259.6
See application file for complete search history.

(56) References Cited

U.S. PATENT DOCUMENTS

| | | | |
|---|---|---|---|
| 5,919,006 | A | 7/1999 | Calandra, Jr. et al. |
| 6,270,290 | B1 | 8/2001 | Stankus et al. |
| 8,337,120 | B2 | 12/2012 | Li |
| 2007/0269274 | A1 | 11/2007 | Seedsman |

FOREIGN PATENT DOCUMENTS

| | | |
|---|---|---|
| WO | 2008079021 | 7/2008 |
| WO | 2009029012 | 3/2009 |
| WO | 2010074584 | 7/2010 |

* cited by examiner

METHOD OF SUPPORTING A ROCK WALL

FIELD OF THE INVENTION

This invention relates generally to bolting for reinforcement of rock subject to deformation and dilation and, more specifically, to a rock bolt anchor with two anchor types that provide active and passive loading.

BACKGROUND OF THE INVENTION

The prior art teaches a deformable rock anchor that is deformation tolerant, which is used in highly stressed rock masses to achieve reinforcement of these stressed rock masses and prevent large, sudden or catastrophic deformation, movement, dilation or failure of this rock mass.

This rock bolt includes an elongate cylindrical stem, with a threaded portion at a borehole surface portion of the stem, to which a nut and washer or bearing plate may be attached, and three or more stem portions serially extending along the length of the stem with each stem portion followed by an integral anchor, being of shorter extend than the stem portions.

Each integral anchor is capable of locally anchoring the rock bolt in a grouted borehole and each stem portion is adapted to elongate, move and slip relatively to the grouted borehole surround and, by the work done by this movement, absorb energy from the surrounding rock and constrain local rock deformation movement, whilst the rock bolt remains locally anchored by each integral anchor.

The rock bolt of the earlier invention is therefore principally defined by having at least three integral anchors and therefore, in situ, is capable of being locally anchored at three discrete localities along the length of the borehole. These anchor points exclude anchoring, by the bolt and bearing plate, at an entrance of the borehole.

The problem experienced with such a rock bolt is that it is reliant, for local anchoring, on the interaction of the anchors on the grout within the borehole.

SUMMARY OF THE INVENTION

The invention provides a rock bolt for being grouted in a borehole in a rock which includes:

a) an elongate body of a suitable steel material having;
b) a first distal end and an opposed second proximal end;
c) a threaded portion at the second end;
d) a mechanical anchor or a composite anchor at, or at least partially located on, a first end portion of the body;
e) a second anchor integrally formed on the body, between the threaded portion and the mechanical or composite anchor;
f) a first stem portion between the mechanical or composite anchor and the second anchor; and
g) a second stem portion between the second anchor and the threaded portion;
h) wherein the first and second stem portions have a smooth cylindrical surface; and wherein the second anchor is adapted to exceed the diameter of the body in at least one radial direction to be locally anchored in a grouted borehole and is adapted to be harder than the stem portions.

The mechanical anchor may be an expansion shell-type mechanical anchor which is actuated to radially expand into frictional engagement with the walls of the borehole.

The composite anchor may comprise an expansion shell type mechanical anchor component and an integrally formed anchor component which is adapted to exceed the diameter of the body in at least one radial direction, wherein the mechanical anchor component and the integral anchor component are consecutively serially positioned on the rock bolt body.

The second anchor may be positioned on the body between 400 and 700 mm from the second end. Preferably, the second anchor is positioned 600 mm from the second end.

A "mechanical anchor" means an anchor engaged with a rock bolt and which is actively actuated to anchor the rock bolt in a rock hole or, in other words, an anchor that is actively loaded.

A "resistive anchor" means an anchor engaged, or integrally formed, with a rock bolt which is passively actuated to anchor the rock bolt within a rock hole by resistive contact with grout or resin within the hole.

From another perspective, the invention provides a rock bolt which includes an elongate metallic body having a first end and an opposed second end, a threaded portion at the second end, for attaching thereto and locating thereon, a nut and a bearing plate, a mechanical anchor at, or at least partially located on, a first end portion of the body and a first resistive anchor, located between the threaded portion and the mechanical anchor.

The mechanical anchor may be an expansion shell-type anchor.

The first resistive anchor may be integral with the body, formed by adapting a section of the body, between 400 mm and 700 mm from the second end, to exceed the diametric dimension of the cylindrical body at least in one radial direction.

The rock bolt may include a second resistive anchor, located between the mechanical anchor and the first resistive anchor, preferably consecutively serially positioned relatively to the mechanical anchor.

Between the mechanical anchor or the second resistive anchor, the first resistive anchor and the threaded portion respectively, first and second stem portions are defined, each of which are adapted to elongate under a tensile load.

The invention extends to a method of supporting a wall of an excavation which uses a rock bolt having an elongate metallic body with opposed first and second ends, a threaded end portion towards the second end, a mechanical anchor located on the body towards the first end and at least two spaced resistive anchors between the mechanical anchor and the threaded portion, the method including the steps of:

a) drilling a hole in the wall and inserting the rock bolt into the hole;
b) mechanically anchoring the bolt within the hole with the mechanical anchor to define a first anchor location;
c) pre-tensioning the bolt by applying an axial load to the bolt;
d) holding the bolt in pretension between the first anchor location and a second anchor location defined at the mouth of the rock hole;
e) introducing a settable material into the rock hole to set between the rock bolt and the walls of the rock hole to define a third and fourth anchor location respectively about each of the resistive anchors.

BRIEF DESCRIPTION OF THE DRAWINGS

The invention is further described by way of example with relevance to the accompanying drawings in which.

DESCRIPTION OF PREFERRED EMBODIMENT

Figure 1:
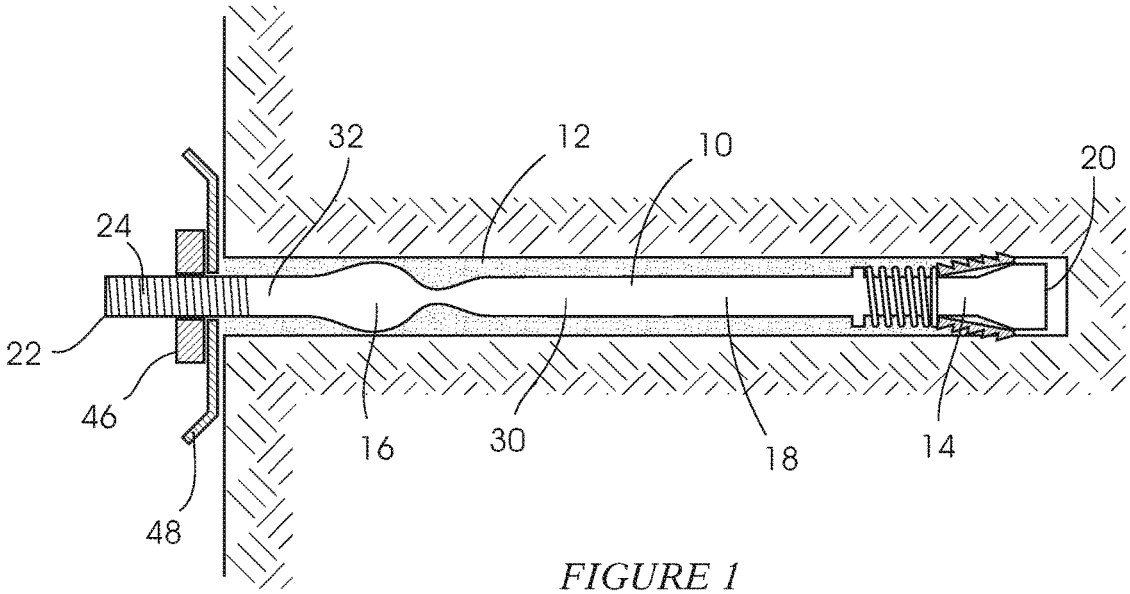
FIG. 1 is a view in elevation of a rock bolt, in a first embodiment of the invention, inserted into a borehole.

FIG. 1 of the accompanying drawings illustrates a rock bolt 10, in accordance with a first embodiment of the invention, which is adapted to be inserted into a rock hole 12, anchored within the rock hole 12 by a mechanical anchor 14, and then, after grout is introduced into the rock hole 12, to be additionally anchored, at a second locality, by an integral anchor 16 which is designed to resist passage through the grouted rock hole.

The rock bolt 10 has a solid cylindrical steel body 18, which extends between a first distal end 20 and a second proximal end 22, which projects out of the rock hole 12.

A section of the rock bolt body 18, extending from the second end 22 is threaded, to define a threaded portion 24.

The mechanical anchor 14, of an expansion shell-type, is located at the distal end 20. This expansion shell-type mechanical anchor can be of any suitable configuration known to the art. However a specific preferred expansion shell anchor is described below as a non-limiting example.

The integral anchor 16 is located between the threaded end section 24 and the mechanical anchor 14. This anchor 16 is integral with the body in that it is formed from the same blank as the body 18.

Figure 2:
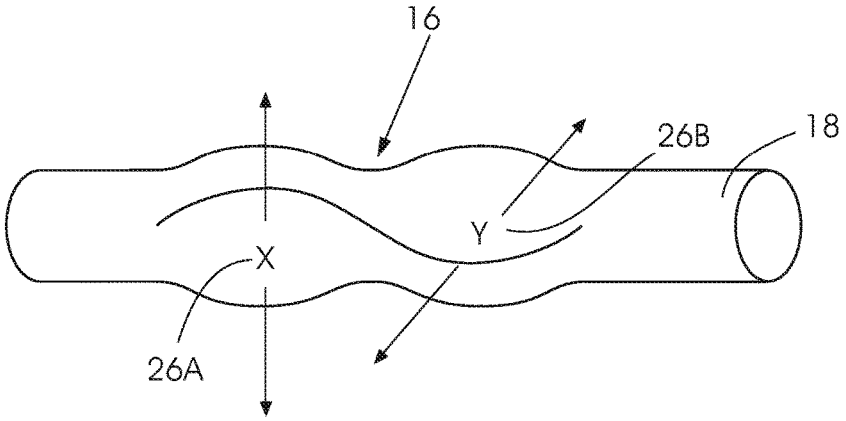
FIG. 2 is a view in perspective of an integral anchor part of the rock bolt.

With reference to FIG. 2, the integral anchor, in a preferred embodiment, comprises a pair of end-to-end paddle formations, respectively designated 26A and 26B. Each paddle formation 26A and 26B lies in a plane which is perpendicular to its counterpart. Each paddle formation 26A and 26B is formed by flattening the rod such that the rock bolt body 18 expands in opposed directions which are orthogonal to the direction of the flattening force (these directions of expansion are designated X and Y respectively). This flattening process is a cold forming process that strain hardens the steel material along the length of the anchor 16. This process also adapts the cylindrical rock bolt body 18 to locally exceed its diameter in radial directions X and Y respectively providing extensions which are resistive to pull through a grouted borehole.

In recognition that the rock, in a typically South African mine excavation, is most densely fractured within the first 300 mm or so, from a rock face, the integral anchor 16 is optimally and preferably positioned on the rock bolt body 18 about 500 mm from the second end 22.

Between the first mechanical anchor 14, the second integral anchor 16 and the threaded section 24, first and second, smooth surfaced, stem portions 30 and 32 are respectively defined.

Figure 3A:
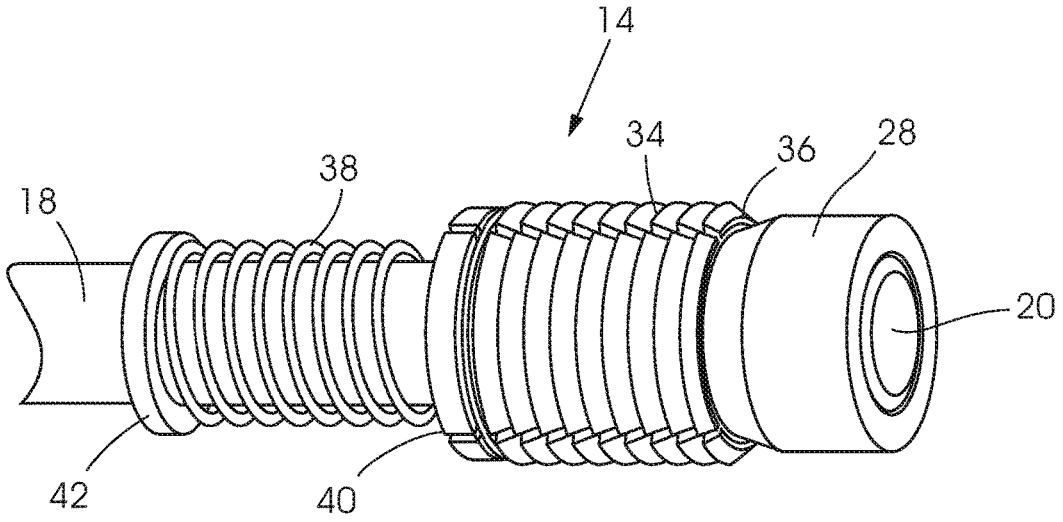
FIGS. 3A and 3B are isometric illustrations of one end of the rock bolt with a mechanical anchor located thereon.
Figure 3B:
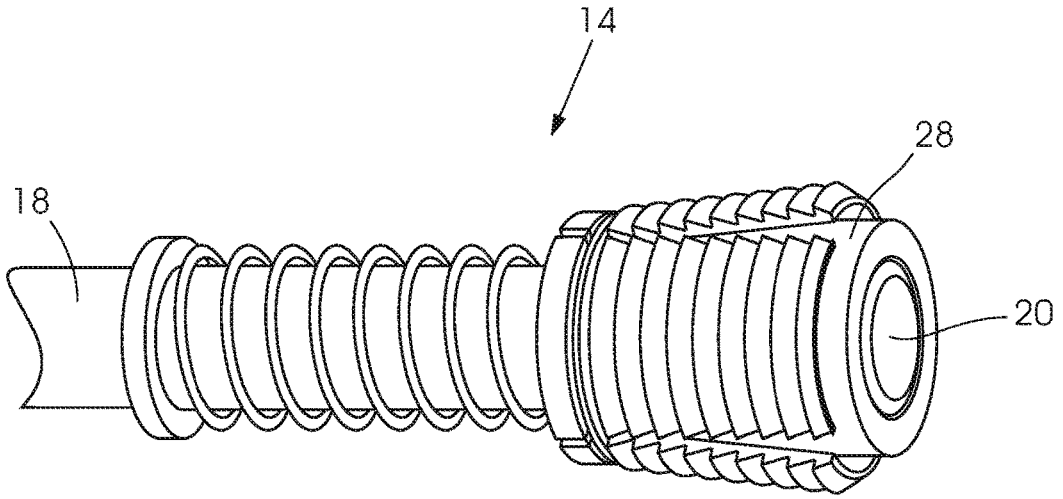

With reference to FIGS. 3A and 3B, the expansion shell-type mechanical anchor 14 includes a tapered nut 28 attached to the first end 20, an expansion shell 34 that abuts the tapered nut 28, in a dis-engaged position illustrated in FIG. 3A, at its leading end 36 and a spring 38, located between a trailing end 40 of the shell 34 and a collar formation 42. The spring 38 biases the shell 34 towards the tapered nut 28 to ride over the tapered nut 28, and radially expand, in an engaged position illustrated in FIG. 3B.

The advantage of the mechanical anchor 14 as described above is that mere insertion of the rock bolt 10 into the rock hole 12, and axial retraction, will actuate the anchor 14 into the engaged position. There is no need to spin the rock bolt 10 to actuate the mechanical anchor 14 to radially expand as is typically with many mechanical anchors known in the art.

A nut 46 and bearing plate 48 are provided, located on the threaded section 24 of the rock bolt body 18.

In a variation (not shown), a tapered formation, provided by the nut 28 in the embodiment described above, can be integrally forged with rock bolt body 18 at the first end 20.

Figure 4:
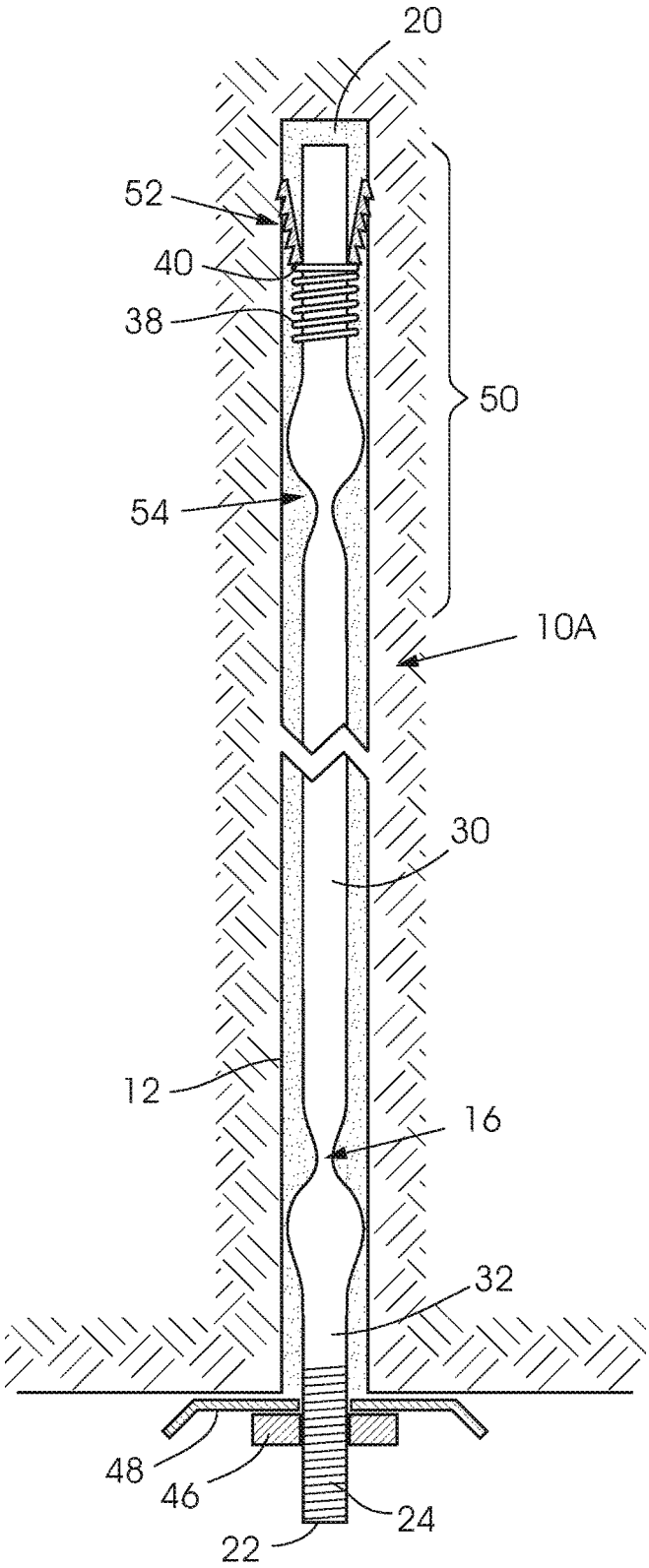
FIG. 4 is a view in elevation of a rock bolt, in a second embodiment of the invention, inserted into a borehole.

FIG. 4 illustrates a second embodiment of the invention, a rock bolt 10A.

In describing this embodiment, like features bear like designations. This embodiment differs, in essence, from the rock bolt 10 of the first embodiment in that it includes a composite anchor 50 which replaces the mechanical anchor 14 and the collar formation 42 of the first embodiment.

The composite anchor includes a mechanical anchor component 52, of the expansion shell-type as described above particularly with reference to FIGS. 3A and 3B, located at the distal end 20 and an integral anchor component 54 consecutively serially positioned with respect to the anchor component 52, back from the component 52.

The integral anchor component 54, in the preferred embodiment, is structurally equivalent to the integral anchor 16 of the rock bolt 10.

Positioned, as it is, in consecutive serial arrangement relatively to the mechanical anchor component 52, the integral anchor component 54 not only provides an additional passively loaded anchor to the rock bolt 10A, it also performs the function provided by the collar formation 42 of the earlier embodiment in that it provides an abutment surface to one end of the spring 38, located between the trailing end 40 of the shell 34 and one end of the anchor component 54.

Figure 5A:
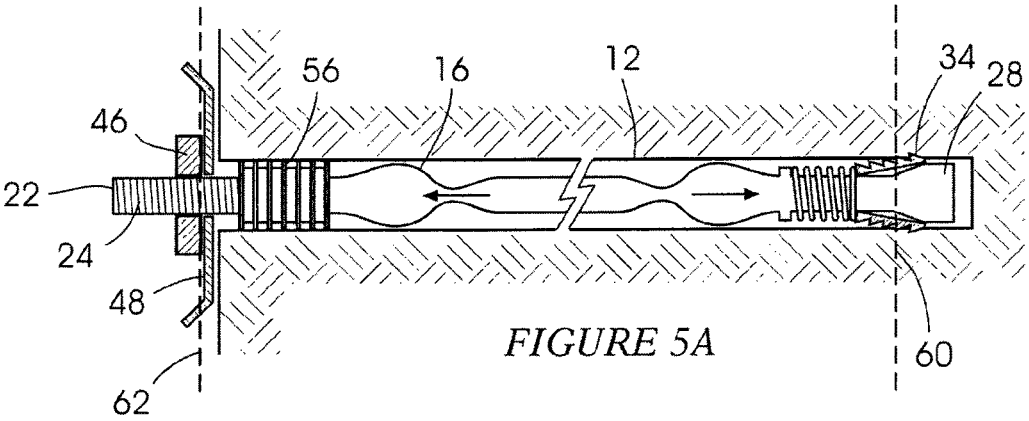
FIGS. 5A to 5C illustrate, in chronological sequence, the rock bolt of the second embodiment in use.
Figure 5B:
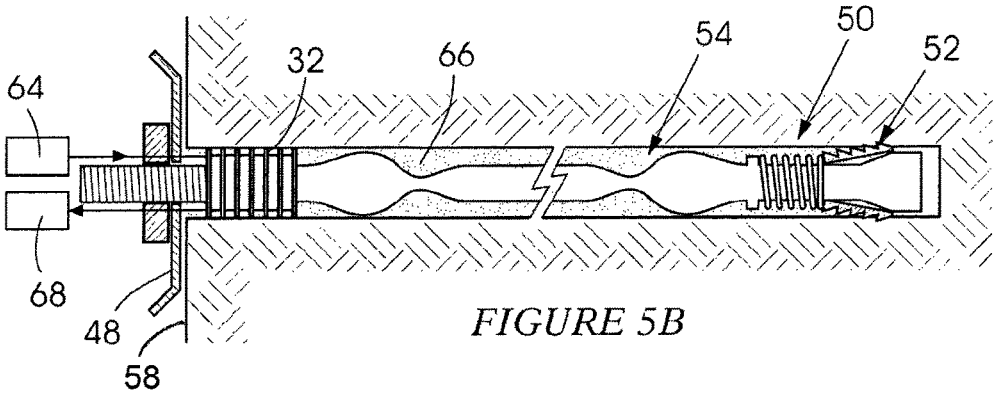
Figure 5C:
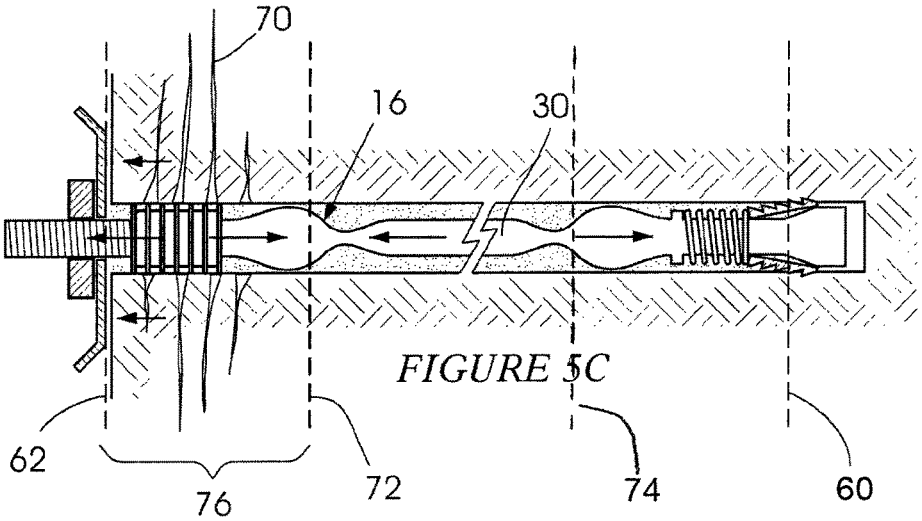

In use, and with reference to FIGS. 5A to 5C, the rock bolt 10A is inserted into a rock hole 12, first end 20 leading, to a point where the threaded portion 24, at least, is projecting from the rock hole 12. The rock bolt 10A, in this preferred embodiment, includes a bung 56, located on the body 18, through which a grout pipe and breather tube (not shown) pass. The bung 56 is located between the threaded portion 24 and the integral anchor 16 and is totally inserted in the rock hole 12. A holed bearing plate 48 is passed over the second end 22 followed by the threaded engagement of a nut 46 to the threaded portion 24.

The bearing plate 48 can be provided with a pair of holes (not shown) on either side of central aperture, to provide respective passage to a grout or resin filler tube and a breather tube.

To actuate the mechanical anchor component 52 of the composite anchor 50 into the engaged position, the rock bolt body 18 is pulled axially outwardly. This action causes the expansion shell 34, which is held in place relatively to the rock bolt body by frictional engagement with the walls of the rockhole 12, to ride over the tapered nut 28, radially dilating in the process into loaded contact with the walls of the rock hole 12. The rock bolt 10A is now locked in the rock hole 12 at this location, a first anchor location (illustrated as a dotted line 60).

With reference to FIG. 5A, tightening of the nut 46, along the threaded 25 portion 24, to bear against the bearing plate 48, forcing the plate against the rock face 58, defines a second anchor location (illustrated as a dotted line designated 62).

With further tightening of the nut 46, the rock bolt body 18 is pre-tensioned (the opposed forces directionally illustrated by arrows in FIG. 5A), prior to the grouting of the rock hole 12, between the first and the second anchor locations (60, 62) thus actively providing reactive load support to the rock mass between the two locations 60 and 62.

With reference to FIG. 5B, grout, from a source 64, is now introduced into an annular space 66, via the grout or filler tube, between the walls of the rock hole 12 and the rock bolt 10A until the annular space 66 is fully grouted as illustrated. As grout fills the annular space 66, displaced air 68 passes out of the hole through the breather tube. The rock bolt 10A is now locked in pre-tension.

The bung 56 seals the rock hole 12 from egress of the grout out of the rock hole 12 once introduced.

FIG. 5C illustrates the highly fractured layer of the rock mass described above, dilating about surface parallel stress fractures 70, forces are imparted on the bearing plate 48 which is translates into a pulling force on the rock bolt 10A out of the rock hole 12. This pulling force is resisted by the integral anchor 16, which is adapted, due to it exceeding the diametric dimension of the cylindrical rock bolt body 18 in at this point, to resist passage through the now hardened grout, thus providing a third anchor location (illustrated by a dotted line designated 72).

Once the rock bolt 10A is set in the grouted rock hole, with the integral anchor component 54 anchored in the grout, any movement of the surrounding rock mass relatively to the rock bolt 10A will cause the anchors (16, 54) to become passively loaded and anchored by resistive movement through the grouted annular space 66. Thus, about integral anchor component 54, a fourth anchor location (illustrated by a dotted line designated 74) is defined. Ahead of this anchor location 74, the initial anchor location 60, about the mechanical anchor component 52, is rendered inutile as reactive load support is now provided between anchor locations 74 and 72 and between 72 and 62.

The advantage of the rock bolt 10A of the invention is that, between the anchor locations 62, 72 and 74, the rock bolt body 18 can stretch along respective first and the second stem portions (30 and 32) to accommodate any dynamic loading movement.

The stem portions 30 and 32's ability to stretch is uninterrupted along their lengths due to their smooth surface which allows relative movement within the grouted confines of the rock hole 12.

However, prior to dynamic rock movement, with quasi-static movement, caused by dilation in the highly fractious rock layer, the second stem portion 32 is further passively pre-loaded, between the second 62 and third 72 anchor locations to provide support to this layer effectively by clamping this layer of rock 70 between the bearing plate 44 and the integral anchor 16.

The invention claimed is:

1. A method of supporting a rock wall of an excavation using a rock bolt in a hole in the rock wall, the rock bolt having an elongate body with opposed first and second ends, wherein the elongate body includes a threaded portion near the second end, a mechanical anchor near the first end, and at least two spaced apart resistive anchors between the mechanical anchor and the threaded portion, the method comprising:

drilling the hole in the rock wall and inserting the rock bolt into the hole; and without applying a rotational force to the rock bolt, applying an axial load to the rock bolt to mechanically anchor the rock bolt in the hole with the mechanical anchor, passing a bearing plate over the threaded portion and threading a nut onto the threaded portion to press the bearing plate against the rock wall to tension the rock bolt in the hole, with the rock bolt tensioned, introducing a settable material into the hole between the rock bolt and an interior wall of the hole, and when the settable material has set, resisting axial movement of the rock bolt in the hole by the two spaced apart resistive anchors pressing against the settable material, wherein the mechanical anchor includes a tapered nut at the first end of the rock bolt and an expandable shell on the tapered nut, and wherein the application of the axial load moves the expandable shell over the tapered nut and into engagement with the interior wall of the hole, and wherein the mechanical anchor includes a spring urging the expandable shell onto the tapered nut, and wherein action of the spring assists movement of the expandable shell onto the tapered nut when the axial load is applied.

2. The method of claim 1, further comprising allowing the elongate body between the two spaced apart resistive anchors to stretch within the settable material by providing the rock bolt with a smooth surface between the two spaced apart resistive anchors.

3. The method of claim 1, wherein the two spaced apart resistive anchors each exceeds a diameter of the elongate body in a different radial direction.

4. The method of claim 1, wherein one of the two spaced apart resistive anchors nearest the second end is between 400 and 700 mm from the second end.

5. A method of supporting a rock wall of an excavation using a rock bolt in a hole in the rock wall, the rock bolt having an elongate body with opposed first and second ends, wherein the elongate body includes a threaded portion near the second end, a mechanical anchor near the first end, and at least two spaced apart resistive anchors between the mechanical anchor and the threaded portion, and wherein the two spaced apart resistive anchors each exceeds a diameter of the elongate body in a different radial direction and a first one of the two spaced apart resistive anchors nearest the second end is between 400 and 700 mm from the second end, the method comprising:

drilling the hole in the rock wall and inserting the rock bolt into the hole; and without applying a rotational force to the rock bolt, applying an axial load to the rock bolt to mechanically anchor the rock bolt in the hole with the mechanical anchor, wherein the mechanical anchor includes a tapered nut at the first end of the rock bolt and an expandable shell on the tapered nut, and wherein the application of the axial load moves the expandable shell over the tapered nut and into engagement with the interior wall of the hole to define a first anchor location where the expanded shell engages the interior wall, passing a bearing plate over the threaded portion and threading a nut onto the threaded portion to press the bearing plate against the rock wall to tension the rock bolt in the hole and define a second anchor location at the rock wall, wherein the tensioned rock bolt supports rock in the rock wall between the first and second anchor locations, with the rock bolt tensioned, introducing grout into the hole to fill an annular space between the rock bolt and an interior wall of the hole, and when the grout has set, resisting axial movement of the rock bolt in the hole by the two spaced apart resistive anchors pressing against the grout, wherein the first one of the two spaced apart resistive anchors defines a third anchor location and wherein the second and third anchor locations clamp a portion of rock of the rock wall therebetween to provide further support for this portion of the rock of the rock wall; and allowing the elongate body between the two spaced apart resistive anchors to stretch within the grout by providing the rock bolt with a smooth surface between the two spaced apart resistive anchors, wherein the mechanical anchor includes a spring urging the expandable shell onto the tapered nut, and wherein action of the spring assists movement of the expandable shell onto the tapered nut when the axial load is applied.

* * * * *